US010098461B2

(12) United States Patent
Volovsek

(10) Patent No.: US 10,098,461 B2
(45) Date of Patent: Oct. 16, 2018

(54) APPARATUS AND METHOD FOR MOUNTING AN UNDER-CABINET STORAGE SYSTEM

(71) Applicant: K-BLOC, LLC, East Lansing, MI (US)

(72) Inventor: Anton J. Volovsek, East Lansing, MI (US)

(73) Assignee: K-BLOC, LLC, East Lansing, MI (US)

( * ) Notice: Subject to any disclaimer, the term of this patent is extended or adjusted under 35 U.S.C. 154(b) by 288 days.

(21) Appl. No.: 15/179,155

(22) Filed: Jun. 10, 2016

(65) Prior Publication Data

US 2016/0360881 A1 Dec. 15, 2016

Related U.S. Application Data

(60) Provisional application No. 62/174,078, filed on Jun. 11, 2015.

(51) Int. Cl.
*A47B 97/00* (2006.01)
*B21D 39/00* (2006.01)

(52) U.S. Cl.
CPC ..... *A47B 97/00* (2013.01); *B21D 39/00* (2013.01); *Y10T 29/4984* (2015.01); *Y10T 29/49998* (2015.01); *Y10T 29/53943* (2015.01); *Y10T 29/54* (2015.01)

(58) Field of Classification Search
CPC . A47B 97/00; A47B 77/14; F16C 3/03; Y10T 29/4984; Y10T 29/49902; Y10T 29/53943; Y10T 29/49998; Y10T 29/53913; Y10T 29/54; B23P 19/10; B21D 39/00
USPC ..... 312/245, 248
See application file for complete search history.

(56) References Cited

U.S. PATENT DOCUMENTS 6,119,879 A * 9/2000 Acchione ..... A47B 77/10 16/359
6,129,431 A * 10/2000 Hansen, Jr. ..... A47B 96/06 211/90.01
2009/0230070 A1* 9/2009 Anderson ..... A47B 57/583 211/186
2013/0162129 A1* 6/2013 Dange ..... F24C 15/34 312/236

* cited by examiner

*Primary Examiner* — Jermie Cozart
(74) *Attorney, Agent, or Firm* — Knechtel, Demeur & Samlan

(57) ABSTRACT

A unique apparatus and method for mounting an under-cabinet storage system which provides opposed arms having a ratchet mechanism, a sliding anchor bar, and a stationary anchor bar, and fixedly connected to one another by a central support. The under-cabinet storage system does not require tools, hardware, or fasteners to install or remove from the base of a cabinet and is hidden except for the storage compartment that is used to attach a variety of accessories including, but not limited to, cutlery or knife blocks, shelves, paper towel holders, hooks, lights, harnesses, or other structures where drilling holes and using penetrating fasteners are unwarranted, inconvenient, or ill-advised; such as cabinets in kitchens, baths, campers, boats, etc.

18 Claims, 7 Drawing Sheets

APPARATUS AND METHOD FOR MOUNTING AN UNDER-CABINET STORAGE SYSTEM

I. CROSS-REFERENCE TO RELATED APPLICATION

This patent application is a non-provisional application claiming priority from U.S. Provisional Patent Application Ser. No. 62/174,078, entitled Apparatus and Method For Mounting An Under-Cabinet Storage System, filed on Jun. 11, 2015, and is fully incorporated herein by reference.

II. FIELD OF THE INVENTION

The present invention relates to under-cabinet storage systems and, more particularly, to an apparatus and method for mounting an under-cabinet storage system that does not require the additional use of tools or other hardware for installation.

III. DESCRIPTION OF THE PRIOR ART

Under-cabinet systems have been around in the public domain for a long time. A typical under-cabinet system requires certain skill and technical know-how for installing the under-cabinet system in the proper location and alignment and then using the proper mechanical tools (e.g., to drill holes) and other hardware (e.g., nuts, bolts, and other required fasteners along with applicable screw drivers, levelers, and/or other necessary tools, etc . . . ) to secure the under-cabinet system.

Any consumers who do not possess this certain skill and technical know-how to install these under-cabinet systems, however, are unable to install their under-cabinet systems themselves. As a result, these consumers must then hire a contractor to perform this service for them and further bear the burden of this additional expense or cost for installation. Additionally, even for those consumers who do possess this certain skill and technical know-how must likewise bear the burden and expense of purchasing all of the proper mechanical tools and other hardware to accomplish the installation.

Accordingly, Applicant's apparatus and method for mounting an under-cabinet storage system solves these and other problems. Thus, there is a need and there has never been disclosed Applicant's unique under-cabinet storage system.

IV. SUMMARY OF THE INVENTION

The present invention is a unique apparatus and method for mounting an under-cabinet storage system which provides opposed arms having a ratchet mechanism, a sliding anchor bar, and a stationary anchor bar, and fixedly connected to one another by a central support. The under-cabinet storage system does not require tools, hardware, or fasteners to install or remove from the base of a cabinet and is hidden except for the storage compartment that is used to attach a variety of accessories including, but not limited to, cutlery or knife blocks, shelves, paper towel holders, hooks, lights, harnesses, or other structures where drilling holes and using penetrating fasteners are unwarranted, inconvenient, or ill-advised; such as cabinets in kitchens, baths, campers, boats, etc.

V. BRIEF DESCRIPTION OF THE DRAWINGS

The Description of the Preferred Embodiment will be better understood with reference to the following figures.

VI. DETAILED DESCRIPTION OF THE PREFERRED EMBODIMENT

Figure 1:
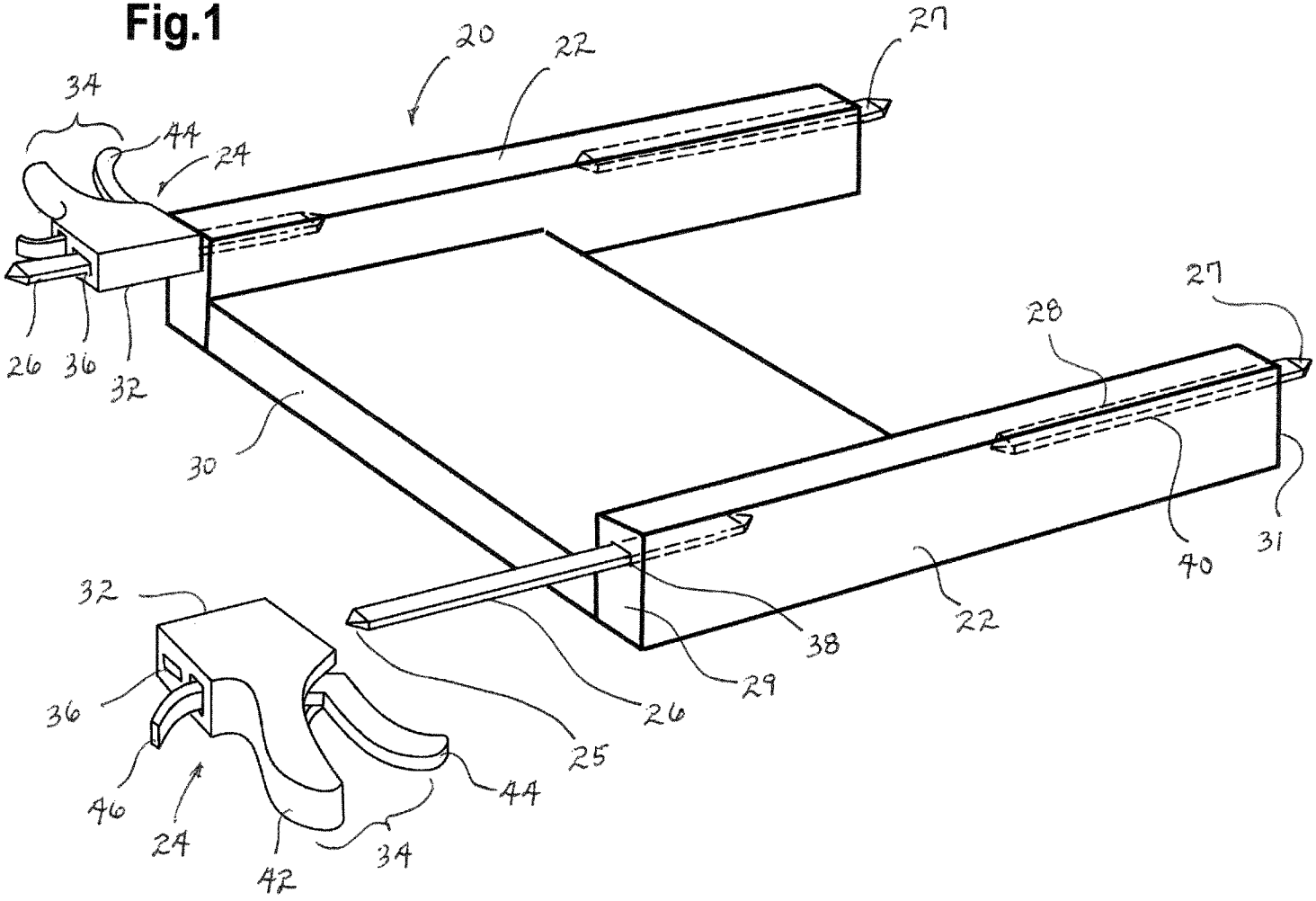
FIG. 1 is a perspective view of Applicant's under-cabinet storage system.

Turning first to FIG. 1, there is illustrated an under-cabinet storage system or device 20. The under-cabinet storage system 20 comprises opposed arms 22 each providing a ratchet mechanism 24, a sliding anchor bar 26, and a stationary anchor bar 28, and fixedly connected to one another by a central support 30.

Figure 8:
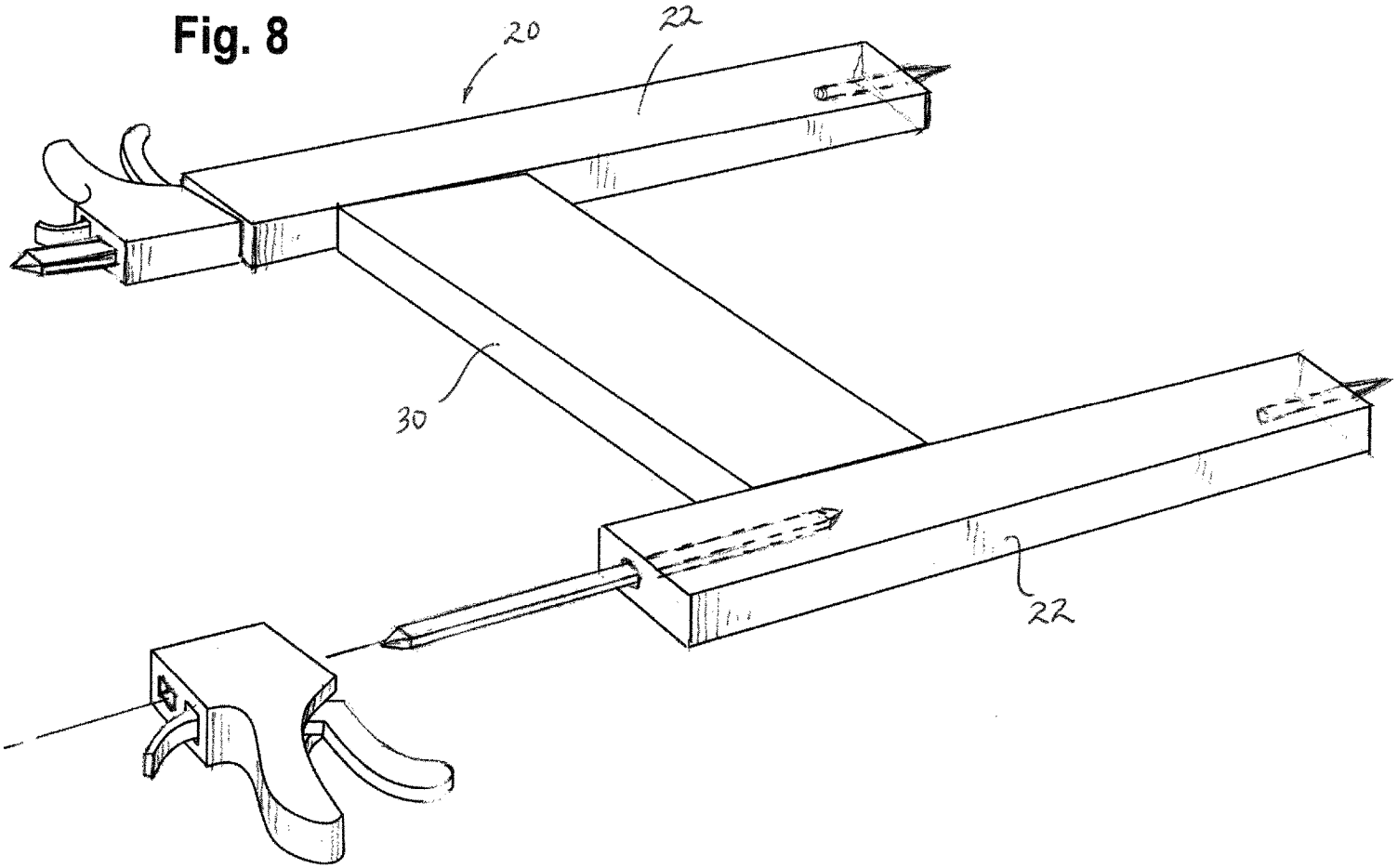
FIG. 8 is a perspective view of the under-cabinet storage system and in particular, illustrating an alternate embodiment of the opposed arms and streamlined profile of the under-cabinet storage system.

The opposed arms 22 and central support 30 are preferably solid members of wood or, alternatively, a durable plastic or any other material known to one skilled in the art that can support compression forces and be drilled, screwed, glued, and/or connected with a variety of sliding anchor bars 26 and stationary anchor bars 28 of any shapes and sizes and further providing sufficient strength to support the under-cabinet storage system 20 as set forth and described herein. Additionally, the opposed arms 22 may have a smaller thickness that is substantially the same as that of the central support 30, as illustrated in FIG. 8, thereby creating an under-cabinet storage system 20 providing a smaller profile design that may accommodate smaller cabinets having a smaller storage opening 49 (see FIG. 2).

The sliding anchor bar 26 is preferably fixedly secured at a proximal end 29 of the opposed arms 22 through frictional insertion of the sliding anchor bar 26 within a bore 38 within the opposed arms 22. Alternatively, the sliding anchor bar 26 may be secured to the opposed arms 22 through any other frictional, non-frictional such as through fasteners, or any other means known to one skilled in the art. The sliding anchor bar 26 is also provided with an anchor point 25. In the preferred embodiment, the anchor point 25 can be made of any shape and/or size and is sharp for engaging the cabinet for installation, as described in more detail below. Alternatively, the anchor point 25 may be affixed with any other means for releaseably engaging the cabinet for installation which includes, but is not limited to, rubber (e.g., rubber ends, rubber grommets, rubber anchors), Velcro® fasteners, or any other means known to one skilled in the art that may be used in connection with any cabinet or walls made of materials other than wood such as tile, marble, etc . . . .

The stationary anchor bar 28 is preferably fixedly secured at a distal end 31 of the opposed arms 22 through frictional insertion of the stationary anchor bar 28 within a second bore 40 within the opposed arms 22. Alternatively, the stationary anchor bar 28 may be secured to the opposed arms 22 through any other frictional, non-frictional such as through fasteners, or any other means known to one skilled in the art. The stationary anchor bar 28 is also provided with a stationary anchor point 27. In the preferred embodiment, the stationary anchor point 27 is likewise sharp for engaging the cabinet for installation, as described in more detail below. Alternatively, the anchor point 27 may be affixed with any other means for releaseably engaging the cabinet for installation which includes, but is not limited to, rubber (e.g., rubber ends, rubber grommets, rubber anchors), Velcro® fasteners, or any other means known to one skilled in the art that may be used in connection with any cabinet or walls made of materials other than wood such as tile, marble, etc . . . .

The ratchet mechanism 24 is preferably a modified mechanical device that allows continuous linear motion for moving the sliding anchor bar 26 in only one direction while preventing motion in the opposite direction. In the preferred embodiment, the ratchet mechanism 24 is made of a ratchet body 32 having an internal gear or locking mechanism, or any other means known to one skilled in the art ("internal mechanism") (not illustrated) adjacent a traversing channel 36 to accommodate the sliding anchor bar 26, and an actuating handle 34 formed by a fixed lever 42 and a moveable lever 44. The sliding anchor bar 26 extends through the traversing channel 36 of the ratchet body 32 and can be moved or advanced in a linear direction through, and outwardly from, the ratchet mechanism 24. This is accomplished upon squeezing the moveable lever 44 together or toward the fixed lever 42 of the actuating handle 34 which advances the sliding anchor bar 26. The moveable lever 44 can be repeatedly squeezed together or toward the fixed lever 42 to continually advance the sliding anchor bar 26 through the ratchet mechanism 24, as desired by the user. The sliding anchor bar 26 can then be returned or moved back through the ratchet body 32 by depressing a release lever 46 which disengages the internal mechanism. This allows the sliding anchor bar 26 to then be moved or retracted in a linear direction back through the traversing channel 36 of the ratchet body 32, and inwardly into, its original position within both the ratchet body 32 and opposed arms 22.

Figure 2:
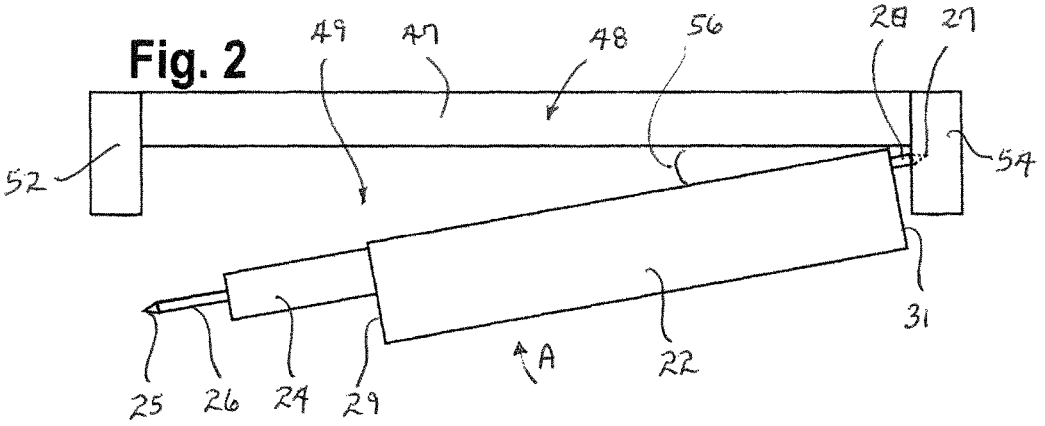
FIG. 2 is a side view of the first step in the process of installing Applicant's under-cabinet storage system to a cabinet.

As illustrated in FIGS. 2 through 7, the under-cabinet storage system 20 is shown being installed and removed. A cabinet 48 is provided having a base 47, a front wall 52, and a back wall 54 separated by a distance 50 (see FIG. 3), and defining a storage opening 49. In the first step to begin the installation process, as illustrated in FIG. 2, the under-cabinet storage system or device 20 is placed in position between the interior of the front wall 52 of the cabinet 20 and the back wall 54. The under-cabinet storage system 20 is situated at an angle 56, which is acute, to the base 47 of the cabinet 48. In this manner, the stationary anchor point 27 for each opposed arms 22 is placed in the desired location against the back wall 54 to partially engage and hold the distal end 31 of the under-cabinet storage system 20 against the back wall 54. With the distal end 31 of the under-cabinet storage system 20 partially engaged and held in place to the back wall 54, the under-cabinet storage system 20 is then rotated in the direction of Arrow A. Then, proceed to the second step.

Figure 3:
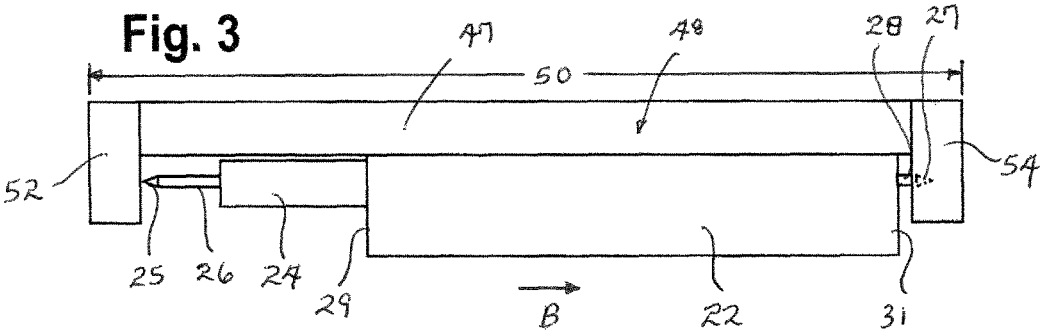
FIG. 3 is a side view of the second step in the process of installing Applicant's under-cabinet storage system to a cabinet.

In the second step to continue the installation process, as illustrated in FIG. 3, the under-cabinet storage system 20 is continued to be rotated in the direction of Arrow A until the under-cabinet storage system 20 is positioned parallel and adjacent to the base 47, between both the front wall 52 and back wall 54, and within the storage opening 49. In this position, the angle 56 is preferably zero. The under-cabinet storage system 20 is then moved in the direction of Arrow B to force the stationary anchor point 27 for each opposed arms 22 further into the back wall 54 thereby releaseably fixing or frictionally securing the distal end 31 of the under-cabinet storage system 20 to the back wall 54. Then, proceed to the third step.

Figure 4:
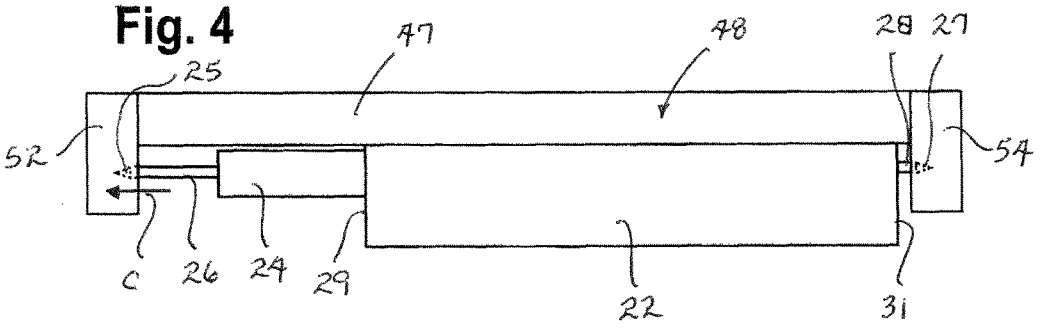
FIG. 4 is a side view of the third step in the process of installing Applicant's under-cabinet storage system to a cabinet.

In the third step to complete the installation process, as illustrated in FIG. 4, the ratchet mechanism 24, and specifically, the actuating handle 34 of each ratchet mechanism 24, is then repeatedly squeezed thereby forcing the sliding anchor bar 26, in the direction of Arrow C, in a linear direction through the traversing channel 36 of the ratchet body 32 and outwardly, from the under-cabinet storage system 20 toward the front wall 52. This continues until the anchor point 25 of the sliding anchor bar 26 is placed and sufficiently forced into the front wall 52 thereby releaseably fixing or frictionally securing the proximal end 29 of the under-cabinet storage system 20 to the front wall 52.

Figure 5:
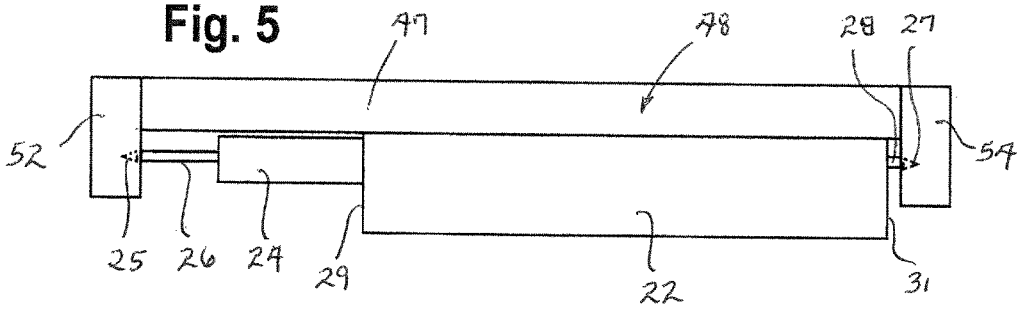
FIG. 5 is a side view of the completion of the process of installing Applicant's under-cabinet storage system to a cabinet.

In this manner, the force of each of the sliding, anchor bar 26 against the front wall 52 of the cabinet 48 and each of the stationary anchor bar 28 against the back wall 54 of the cabinet 48, in combination, fixedly secures both of the opposed arms 22 in position with the under-cabinet storage system 20 and hidden under the cabinet 48 within the storage opening 49, as illustrated in FIG. 5. The under-cabinet storage system 20 is now ready for use as set forth and described in more detail below.

The under-cabinet storage system or device 20 can be easily removed by reversing the same process. Proceed to the fourth step.

Figure 6:
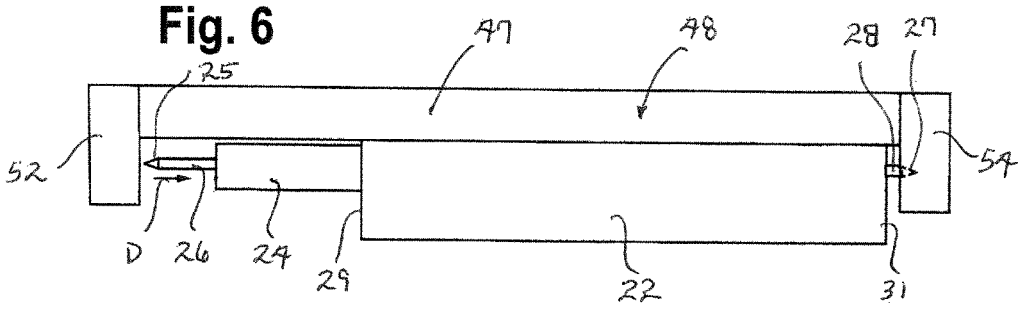
FIG. 6 is a side view of the fourth step in the process of removing Applicant's under-cabinet storage system from a cabinet.

In the fourth step to begin the removal process, as illustrated in FIG. 6, the ratchet mechanism 24, and specifically, the sliding anchor bar 26 is then released from the front wall 52 of the cabinet 48. To accomplish this, the release lever 46 (see FIG. 1) is depressed to disengage the internal mechanism. The sliding anchor bar 26 is then forced, in the direction of Arrow D, in a linear direction back through the traversing channel 36 of the ratchet body 32, and inwardly into its original position within both the ratchet body 32 and opposed arms 22 to thereby remove the anchor point 25 for each opposed arms 22 from the front wall 52 and thereby release the proximal end 29 of the under-cabinet storage system 20 from the front wall 52. Then, proceed to the fifth step.

Figure 7:
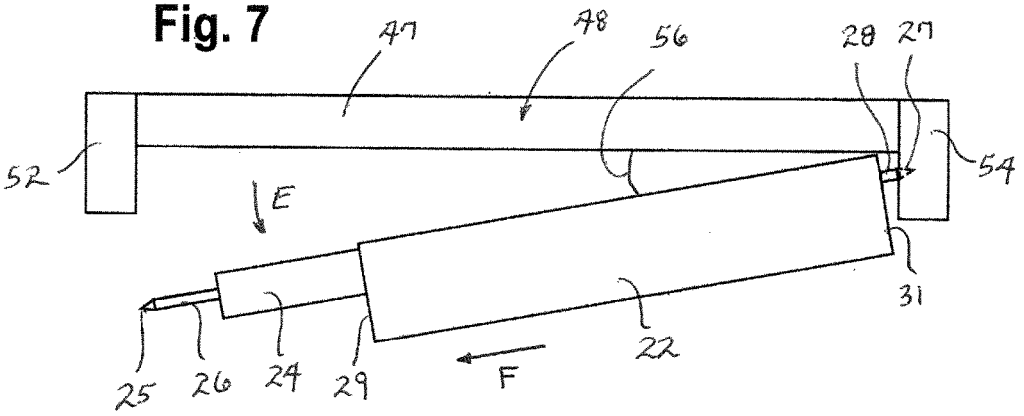
FIG. 7 is a side view of the fifth step and completion of the process of removing Applicant's under-cabinet storage system from a cabinet.

In the fifth step to complete the removal process, as illustrated in FIG. 7, the proximal end 29 of the under-cabinet storage system 20 is then rotated, in the direction of Arrow E, outwardly and away from the cabinet 48 (i.e., base 47, the front wall 52, and from within the storage opening 49). The acute angle of the angle 56 also returns.

The under-cabinet storage system 20 is then moved in the direction of Arrow F to remove the stationary anchor point 27 for each opposed arms 22 from the back wall 54 and thereby release the distal end 31 of the under-cabinet storage system 20 from the back wall 54. Upon completion, the under-cabinet storage system 20 is now completely removed from the cabinet 48.

The above installation and removal process of the under-cabinet storage system 20, as illustrated in FIGS. 2 through 7, may be repeated as many times or placed in any location under the cabinet 48, as desired.

Figure 9:
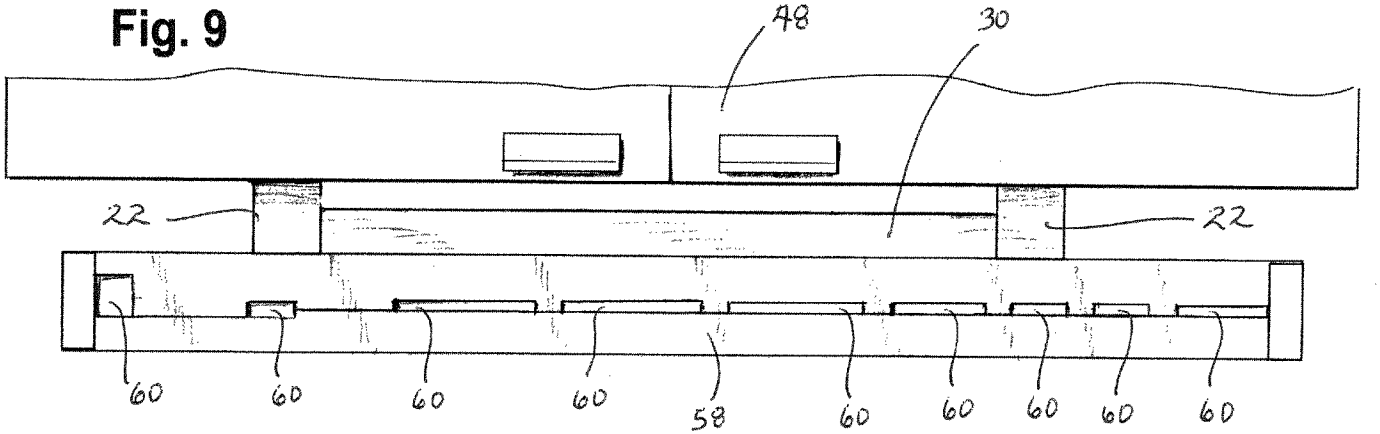
FIG. 9 is a front perspective view of the under-cabinet storage system and, in particular, illustrating the under-cabinet storage system as installed under a cabinet and providing the storage compartment having a plurality of compartments for the storage of various kitchen accessories, products, or materials.

When the under-cabinet storage system 20 is installed and ready for use as illustrated in FIG. 9, the opposed arms 22, the ratchet mechanism 24, the sliding anchor bar 26, and the stationary anchor bar 28 are all hidden behind the front wall 52 of the cabinet 48. The central support 30 and storage compartment 58 are preferably the only part of the under-cabinet storage system 20 that remains visible.

Figure 10:
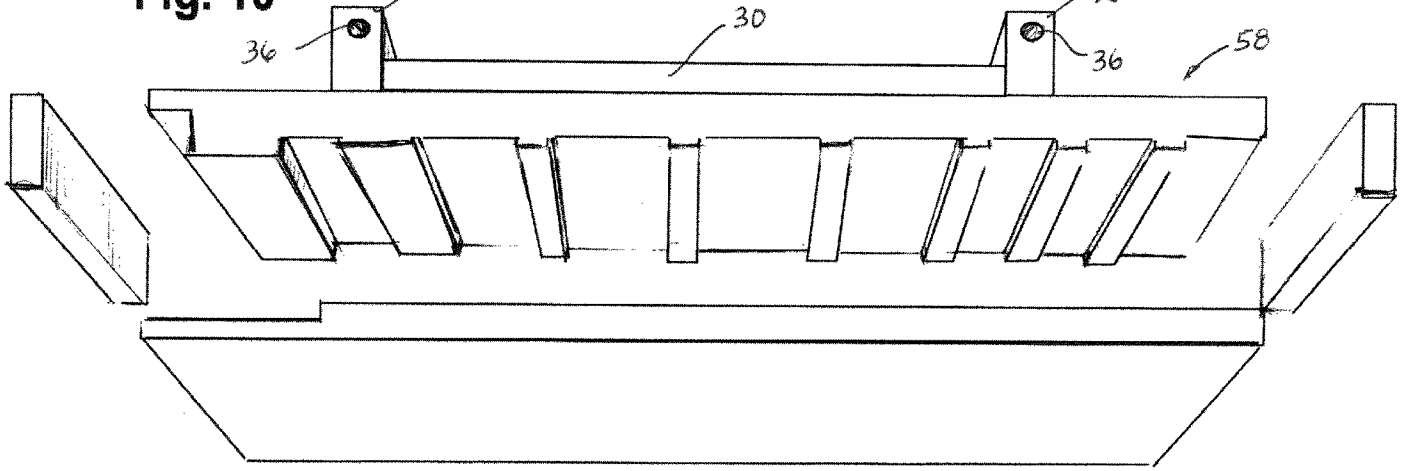
FIG. 10 is a front perspective exploded view of the under-cabinet storage system as illustrated in FIG. 9 and in particular, illustrating the plurality of compartments for the storage of various kitchen accessories, products or other materials.

In the preferred embodiment, the storage compartment 58 is a compartment for storing cutlery or any other type of kitchen accessories. The storage compartment 58 contains a plurality of compartments 60 that, when in use, provide a convenient and easy means in the kitchen to access, use, and store the cutlery or other type of kitchen accessories, as desired by the user. An exploded view of the storage compartment 58 and, in particular, the plurality of compartments 60 is more clearly illustrated in FIG. 10. Alternatively, the plurality of compartments 60 may be designed to store any products or materials desired by the user.

In this embodiment, the storage compartment 58 is mounted to both the central support 30 and the opposed arms 11. The storage compartment 58 may be integrated or formed with the central support 30 and the opposed arms 11 as a single unitary member. Alternatively, the storage compartment 58 may be mounted to the central support 30 and the opposed arms 11 using any fastening means known to one skilled in the art such nuts, bolts, screws, Velcro® fasteners, etc . . . . The embodiment used shall be dependent upon the weight of the under-cabinet storage system 20 including the storage compartment 58 and the accessories stored therein.

Figure 11:
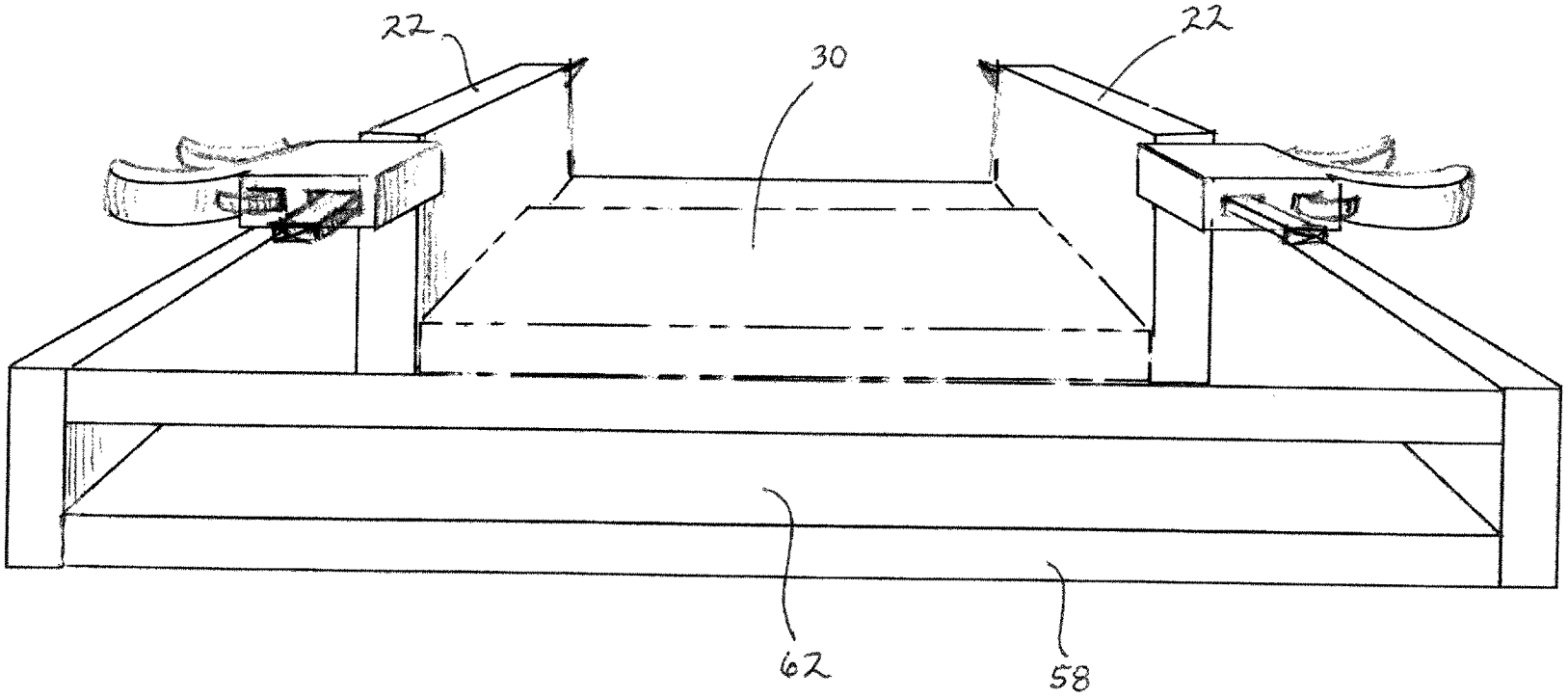
FIG. 11 is a front perspective view of the under-cabinet storage system and, in particular, illustrating the alternate embodiments of including or not including a central support and a first alternate embodiment of the storage compartment as an open shelf for the storage of a cutting board, cookbook, or any other products or materials.

As illustrated in FIG. 11, the storage compartment 58, in an alternate embodiment, may be an open shelf 62 for storing a cutting board, cookbook, or any other accessories, products, or materials ("materials"), desired by the user. Additionally, the central support 30 is shown in phantom to illustrate that (1) the central support 30 may be included in the under-cabinet storage system 20 to facilitate a dual purpose of (a) being able to assist the under-cabinet storage system 20 in accommodating additional weight that may be incurred from the materials stored in the storage compartment 58; and (b) with its positioning between the opposed arms 22, the central support 30 also strengthens the under-cabinet storage system 20 by preventing undesired rotation that could occur between the storage compartment 58 and the opposed arms 22 in its absence; or alternatively, (2) the central support 30 does not have to be included in the under-cabinet storage system 20. In this manner, the storage compartment 58 is mounted directly to only the opposed arms 22.

Figure 12:
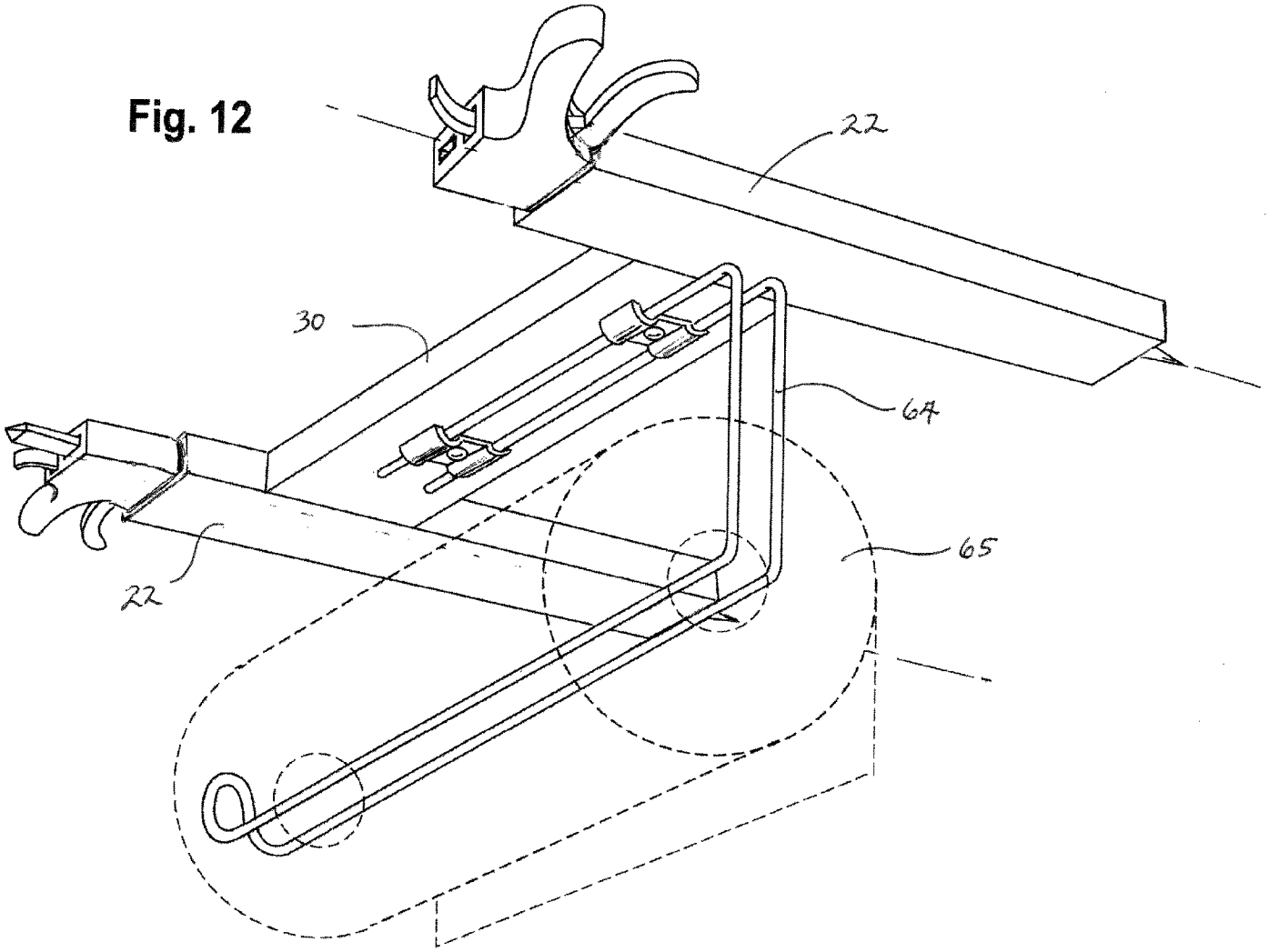
FIG. 12 is a perspective view of the under-cabinet storage system and, in particular, illustrating a second alternate embodiment of a hanging means that is designed or shaped to accommodate the storage and use of a paper towel holder or any various kitchen accessories, products, or other materials.

As illustrated in FIG. 12, and using the same embodiment as illustrated in FIG. 8, the under-cabinet storage system 20 may be provided with a hanging means 64 that is in the design or shape to accommodate the storage and use of a paper towel holder 65. Alternatively, the hanging means 64 may be used to store any other materials or hang anything, including lights, etc . . . . Additionally, the hanging means 64 may be mounted or affixed to the central support 30, the opposed arms 22, or both, as desired.

Thus, there has been provided Applicant's unique apparatus and method for mounting an under-cabinet storage system 20 and which does not require tools, hardware, or fasteners to install or remove. The under-cabinet storage system 20 is used to attach a variety of accessories including, but not limited to, cutlery or knife blocks, shelves, paper towel holders, hooks, lights, harnesses, or other structures where drilling holes and using penetrating fasteners are unwarranted, inconvenient or ill-advised; such as cabinets in kitchens, baths, campers, boats, etc . . . . Alternatively, the customization of components of Applicant's device can be modified to be used as a temporary mounting device between rafters, joists, wall studs or other parallel, vertical surfaces and is easily removed. Additionally, multiple mounting systems can be sized and connected by additional framing material and oriented in a variety of ways to suit the application and appended claims.

While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope of the specification.

What is claimed is:

1. A device, comprising:

opposed arms having a proximal end and a distal end, the proximal end and the distal end each providing an opening into an internal bore;

a support securing the opposed arms parallel to one another and disposing the opposed arms in a common plane;

a stationary anchor bar releaseably secured through the opening and into the internal bore of the distal end of each of the opposed arms, a stationary anchor point of the stationary anchor bar extending outwardly from the distal end;

a sliding anchor bar releaseably secured through the opening and into the internal bore of the proximal end of each of the opposed arms, a portion of the sliding anchor bar extending outwardly from the proximal end and providing an anchor point;

a ratchet body having opposed ends and providing a traversing channel between the opposed ends; and means for advancing the portion of the sliding anchor bar extending outwardly from the proximal end of the opposed arms through the traversing channel from one opposed end of the ratchet body for the anchor point to extend outwardly from the other opposed end of the ratchet body.

2. The device of claim 1 and further comprising a storage compartment situated adjacent and parallel to the common first plane.

3. The device of claim 2 wherein the storage compartment provides at least one open compartment.

4. The device of claim 2 and further comprising a cabinet having a base, a front wall, a back wall, and defining an opening between them, with the opposed arms releaseably mounted between the front wall and the back wall within the opening.

5. The device of claim 4 wherein the stationary anchor point of the stationary anchor bar engages the back wall and the anchor point of the sliding anchor bar engages the front wall.

6. The device of claim 5 wherein the common plane of the opposed arms is parallel to the base.

7. The device of claim 3 wherein the storage compartment is mounted to the support.

8. The device of claim 3 wherein the support forms a part of the storage compartment.

9. The device of claim 1 wherein the means for advancing the portion of the sliding anchor bar extending outwardly from the proximal end of the opposed arms through the traversing channel from one opposed end of the ratchet body for the anchor point to extend outwardly from the other opposed end of the ratchet body comprises an actuating lever.

10. A device, comprising:

at least two arms having a proximal end and a distal end, the proximal end and the distal end each providing an opening into an internal bore;

a stationary anchor bar releaseably secured through the opening and into the internal bore of the distal end of each of the at least two arms, a stationary anchor point of the stationary anchor bar extending outwardly from the distal end;

a sliding anchor bar releaseably secured through the opening and into the internal bore of the proximal end of each of the at least two arms, a portion of the sliding anchor bar extending outwardly from the proximal end and having an anchor point;

a ratchet body having opposed ends and providing a traversing channel between the opposed ends; and means for advancing the portion of the sliding anchor bar extending outwardly from the proximal end of the opposed arms through the traversing channel from one opposed end of the ratchet body for the anchor point to extend outwardly from the other opposed end of the ratchet body.

11. A method for installing a device between a first and second opposed surfaces, comprising the steps of:

providing the device having a front side and a back side, a sliding anchor bar extending outwardly from the front side and a stationary anchor bar extending outwardly from the back side;

placing the device between the first and second opposed surfaces and orienting the device in parallel alignment with the first and second opposed surfaces;

securing the stationary anchor bar against the first opposed surface;

advancing the sliding anchor bar further outwardly from the front side toward the second opposed surface; and securing the sliding anchor bar against the second opposed surface.

12. The method of claim 11 and further comprising the step of providing a storage compartment.

13. The method of claim 12 and further comprising the step of defining a first plane between a bottom of each of the first and second opposed surfaces and positioning the storage compartment in a second plane that is adjacent to the first plane.

14. The method of claim 12 and further comprising the step of positioning the device at an angle to the first opposed surface.

15. The method of claim 14 and further comprising the step of placing the stationary anchor bar against the first opposed surface to hold the back side of the device in position.

16. The method of claim 11 and further comprising the step of rotating the device for placement of the front side adjacent to the second opposed surface.

17. The method of claim 16 and further comprising the step of applying pressure to move the device in the direction toward the first opposed surface.

18. The method of claim 11 and further comprising the step of providing a base affixed between the first and second opposed surfaces and positioning the device up against and parallel to the base.

* * * * *